United States Patent [19]

Nakamura

[11] Patent Number: 4,766,341

[45] Date of Patent: Aug. 23, 1988

[54] COLOR PICTURE TUBE WITH SHADOW MASK HAVING ALTERNATELY DISPLACED APERTURES

[75] Inventor: Koji Nakamura, Nagaokakyo, Japan

[73] Assignee: Mitsubishi Denki Kabushiki Kaisha, Tokyo, Japan

[21] Appl. No.: 908,896

[22] Filed: Sep. 18, 1986

[30] Foreign Application Priority Data

Sep. 18, 1985 [JP] Japan ..... 60-208005
Feb. 21, 1986 [JP] Japan ..... 61-37701

[51] Int. Cl.[4] ..... H01J 29/07
[52] U.S. Cl. ..... 313/402
[58] Field of Search ..... 313/402, 403, 407, 408

[56] References Cited

U.S. PATENT DOCUMENTS 3,872,345 3/1975 Yamazaki et al. ..... 313/402 X
3,900,757 8/1975 Kaplan ..... 313/408 X

*Primary Examiner*—David K. Moore
*Assistant Examiner*—Sandra L. O'Shea
*Attorney, Agent, or Firm*—Lowe, Price, LeBlanc, Becker & Shur

[57] ABSTRACT

A color picture tube of a shadow mask system comprises a shadow mask formed with apertures arrayed in such a pattern that lines connecting adjacent ones of the apertures arrayed at least in one of a major axis direction and a minor axis direction on a display surface are obtained in the form of polygonal lines.

14 Claims, 6 Drawing Sheets

COLOR PICTURE TUBE WITH SHADOW MASK HAVING ALTERNATELY DISPLACED APERTURES

BACKGROUND OF THE INVENTION

1. Field of the Invention

The present invention relates to a color picture tube, and more particularly, it relates to a color picture tube of a shadow mask type which is applicable to a display unit of high resolution employed in a terminal unit of a computer or the like.

2. Description of the Prior Art

FIG. 1 schematically illustrates the structure of a general color picture tube to which the present invention is applied.

Referring to FIG. 1, an envelope 1 of a glass vacuum vessel comprised by a front panel 2 whose inner surface is coated with a fluorescent screen 3 serving as a display surface, a funnel portion 4 connected with the front panel 2 and a neck portion 5 containing electron guns 6. A shadow mask 7 is suspended in the envelope 1 oppositely to the fluorescent screen 3 through pins (not shown) provided in a skirt portion of the front panel 2.

FIG. 2 illustrates relation between a circular-aperture type shadow mask having circular apertures and a display surface (screen). Symbol A denotes an enlarged part of the display surface 3 formed by a fluorescent screen and symbol B denotes an enlarged part of the shadow mask 7. Symbols X and Y denote a major axis and a minor axis of a color cathode-ray tube (CRT), i.e., an in-line array direction of electron guns 6 and a direction perpendicular thereto. The electron guns 6 are arrayed in order of BG for blue, GG for green and RG for red from the left-hand direction of FIG. 2.

Referring to FIG. 2, circular fluorescent dots 9 corresponding to three colors of blue, green and red for example are baked to the display surface 3 in correspondence to an aperture 8 of the shadow mask 7 as shown in the enlarged part B. Thus, the fluorescent display screen 3 as shown in the enlarged part A of FIG. 2 is formed by the fluorescent dots 9 of the three colors, while the fluorescent dots 9 of one of the three colors, e.g., those of red are in the pattern as shown at the enlarged part B. This also applies to those of the remaining two colors.

In general, the fluorescent dots 9 are larger in pitch than the apertures 8 of the shadow mask 7 for the reason that the shadow mask 7 is separated by a predetermined distance from the inner surface of the front panel 2 so that the aperture pattern of the shadow mask 7 is enlarged on the inner surface of the front panel 2. The ratio of such enlargement is generally about 4 to 5%, although the same depends on the size of the CRT and the structure of the electron guns 6.

One of structural disadvantages of the shadow mask type CRT is a moiré phenomenon.

As is well known in the art, the moiré phenomenon is observed in the form of fringes varied in density between two or more straight lines. In general, the moiré phenomenon mainly appears as a moiré pattern caused by optical interference of the interval between scanning lines and the array of the apertures 8 of the shadow mask 7.

FIG. 3 is a diagram for illustrating the array of the apertures 8 of the shadow mask 7 with reference to an aperture pattern of a partial region of the shadow mask 7 such as that in the vicinity of its center. Referring to FIG. 3, a line connecting apertures $m_3$, $m_{10}$ and $m_{17}$ corresponds to the X axis of the display surface 3 while a line connecting apertures $m_8$, $m_9$, $m_{10}$ and $m_{11}$ corresponds to the Y axis of the display surface 3.

The aperture $m_{10}$ corresponds to the central position of the shadow mask 7. This aperture $m_{10}$ forms an equilateral triangle with the apertures $m_9$ and $m_{13}$ as well as another equilateral triangle with the apertures $m_{13}$ and $m_{14}$. Thus, the aperture pattern of the shadow mask 7 as shown in FIG. 3 is formed by an array of a plurality of equilateral triangles.

Description is now made on directions of adjacent apertures 8. For example, the aperture $m_{10}$ is adjacent to the apertures $m_9$, $m_{13}$, $m_{14}$, $m_{11}$, $m_7$ and $m_6$. Thus, there are three directions of apertures adjacent to the aperture $m_{10}$, i.e., the direction of the apertures $m_{11}$, $m_{10}$, $m_9$ and $m_8$ along the Y axis, that of the apertures $m_4$, $m_7$, $m_{10}$, $m_{13}$ and $m_{16}$ at an angle of 60° with respect to the Y axis and that of the apertures $m_2$, $m_6$, $m_{10}$, $m_{14}$ and $m_{18}$ at an angle of −60° with respect to the Y axis.

Seeing the array of the apertures in broad perspective, the series of $m_1$, $m_8$ and $m_{15}$, the series of $m_5$ and $m_{12}$ and the series of $m_2$, $m_9$ and $m_{16}$ appear linearly in parallel with the X axis on axes $A_0$, $A_1$ and $A_2$ respectively. This also applies to those on other axes.

The moiré pattern in question is mainly caused by optical interference between the pitch of the respective series of apertures on the axes $A_0$, $A_1$, . . . and the pitch of electron beams in scanning.

In the case of a CRT, the moiré phenomenon takes place when two or more lines of different pitches are in parallel with and in specific relation to each other. For example, when $M/N=m/n$ (m, n: positive integers) assuming that the scanning line pitch is M mm and the pitch of the linear series formed by the phosphor dots is N mm, it is preferable to avoid such relation that both of the integers m and n are any of one to four, in order to obtain a good result.

In other words, it runs as follows:

(1) It is preferable that interference fringes formed by the pitches M and N are of a small pitch.

(2) Difference in variable contrast on the screen is preferably small even if the interference fringes are of the same pitch.

These two points are requisites for solving the problem of the moiré phenomenon. In the case of the CRT, it is important to reduce the variation of contrast (the degree of variation of the brightness) in order to reduce moiré fringes, to put it strongly.

The shadow mask 7 is invisible in the exterior of the CRT, and hence the practical subject of discussion is the pitch of the fluorescent dots 9 forming the display surface 3.

Recently, a display unit for a terminal unit of a computer or the like has been improved with higher resolution while a display image on a display surface of a CRT is highly densified with thinner electron beams and a finer fluorescent dot pitch. As the result, a moiré phenomenon caused by optical interference between the pitch of signals (picture signals) and the array of the apertures of the shadow mask has come into question.

With respect to generation of moiré fringes, signals of trouble making are mainly vertical fringes. Referring to FIG. 3, the optical interference in question takes place between straight lines formed by the apertures 8 of the shadow mask 7, i.e., a train of the apertures $m_1$, $m_2$, $m_3$ and $m_4$ along an axis $B_0$, a train of apertures $m_5$, $m_6$ and $m_7$ along an axis $B_1$ and those of respective apertures along axes $B_2$, $B_3$, $B_4$, . . . and the pitch of signals (of linear image). Also in this case, the moiré phenomenon can be explained through the relation of $M/N=m/n$ similarly to the interference with the scanning line pitch.

Description is now made in further detail with reference to FIGS. 4(A) and 4(B).

FIG. 4(A) shows a pattern of, e.g., red fluorescent dots in a conventional fluorescent screen 3 or an array of apertures of a shadow mask 7. When vertical lines (straight lines along a direction Y) are displayed on the display surface (fluorescent screen) 3, symbol W denotes the width of signals, i.e., that of electron beams. Considering a section along the X axis of the display surface 3, the light emission state thereof is as shown in FIG. 4(B), in alignment with the dot array shown in FIG. 4(A). Although the optical outputs are discontinuous as obvious from FIG. 4(B), the same are continuously seen by the human eye, which recognizes objects macroscopically. From a reverse point of view, the display surface 3 is formed by a sufficiently small dot pitch applicable to resolution of the human eye.

There are two problems with respect to the moiré phenomenon. One of the problems resides in the size b as shown in FIG. 4(B), which represents the dot pitch of the components in the direction X, i.e., the aperture pitch of the shadow mask 7, which causes a moiré phenomenon similar to that through the aforementioned relation $M/N=m/n$. The other problem resides in relation $a \neq b$ and $b \neq c$ on ends of electron beams. Assuming that three beams of red, blue and green hit a completely identical position on the display surface 3, white luminescence is observed in the inner sides (central portions) of the electron beams since all of the three-color dots emit light, whereas the color balance is lost to provide colored luminescence at beam end portions due to the aforementioned relation of $a \neq b$ and $b \neq c$ as well as variation of dot positions depending on the colors of the fluorescence.

SUMMARY OF THE INVENTION

The present invention is proposed to overcome the aforementioned disadvantages, and an object thereof is to provide a color picture tube which can reduce moirés taking place between signal patterns and fluorescent dot patterns at the smallest sacrifice of color purity margin.

The present invention is characterized in that a color picture tube of a shadow mask type having a major axis direction and a minor axis direction comprises a shadow mask formed with apertures such that lines connecting adjacent apertures arrayed along the axial direction of at least one of the major and minor axis directions of a display surface are formed as polygonal lines intersecting with the axis of the said axial direction at a predetermined angle every aperture or every plurality of apertures. The angle formed by the said lines and the axis is set to be smaller in peripheral parts of the display surface than that in the central part thereof.

According to the present invention, the apertures of the shadow mask are arrayed in, so to speak, a zigzag manner to reduce strength of the linear pattern formed by the dot pattern, i.e., the aperture array of the shadow mask thereby to further reduce the intensity of the linear pattern in fine patterns of lines forming optical outputs in display of signals such as vertical lines, and hence generation of moirés and coloring at ends of the lines can be reduced. Particularly when the bent angle of the aforementioned polygonal lines is smaller in peripheral parts of the display surface than that in the central part, degradation of color purity margin can be restricted.

These and other objects, features, aspects and advantages of the present invention will become more apparent from the following detailed description of the present invention when taken in conjunction with the accompanying drawings.

BRIEF DESCRIPTION OF THE DRAWINGS

FIG. 10 shows a modification of the array of FIG. 5(A).

DESCRIPTION OF THE PREFERRED EMBODIMENTS

Embodiments of the present invention are now described with reference to the accompanying drawings.

Figure 1:
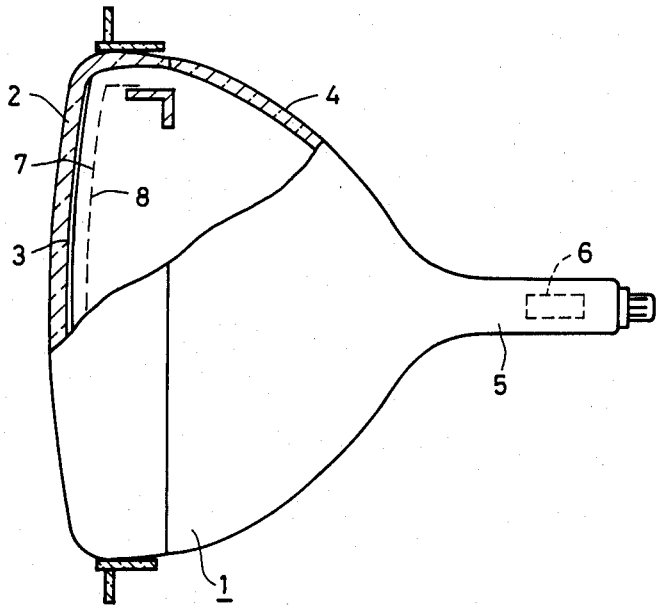
FIG. 1 schematically illustrates a general color picture tube of a shadow mask system.
Figure 2:
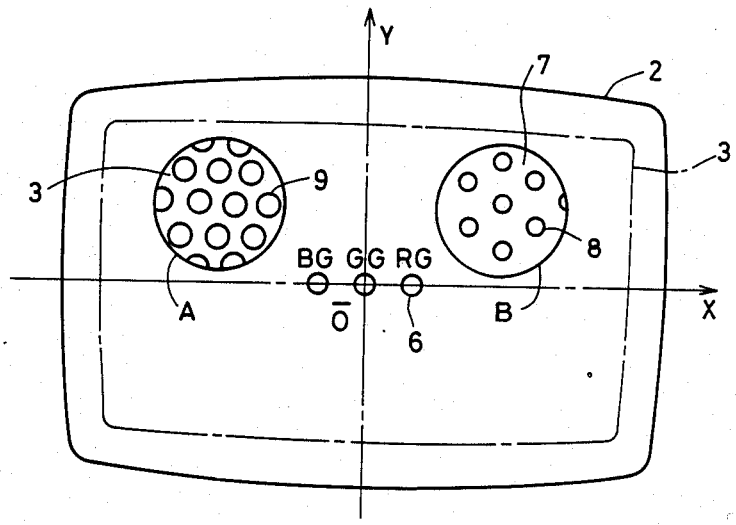
FIG.2 PRIOR ART
FIG. 2 is a schematic front elevational view of a color picture tube for illustrating array of apertures of a shadow mask and a pattern of fluorescent dots.
Figure 3:
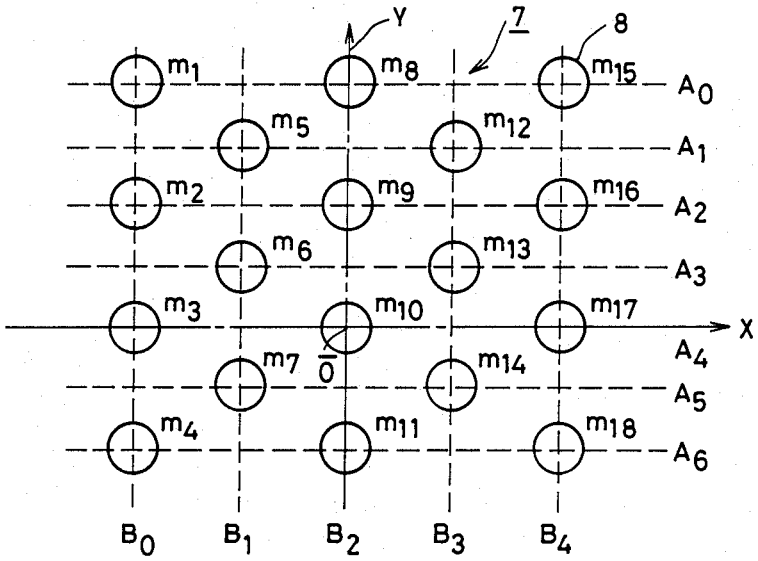
FIG.3 PRIOR ART
FIG. 3 is a pattern diagram showing a conventional aperture array.
Figure 5A:
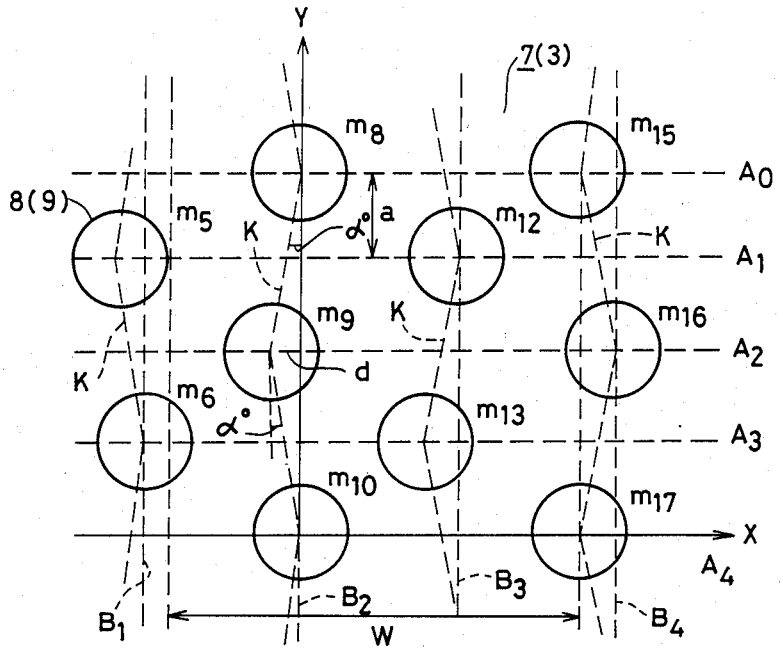
FIG. 5(A) illustrates an aperture array of a shadow mask or a dot pattern on a display surface according to an embodiment of the present invention.

FIG. 5(A) is an enlarged view showing an aperture array of a shadow mask 7 according to an embodiment of the present invention, in which apertures 8 of the shadow mask 7 are shown along axes $A_0$, $A_1$, $A_2$, . . . and $B_0$, $B_1$, $B_2$, . . . in correspondence to FIG. 3.

FIG. 5(A) is different from FIG. 3 in that, for example, the position of an aperture $m_9$ with respect to adjacent apertures $m_8$ and $m_{10}$ is inclined by an angle $\alpha$ with respect to the Y axis and displaced by a distance d in the minus direction (left-hand direction in FIG. 5(A)) on the axis $A_2$, which is parallel with the X axis, in comparison with that of the conventional shadow mask 7. This also applies to other apertures such that, for example, positions of apertures $m_5$, $m_{13}$, $m_{15}$ and $m_{17}$ with respect to adjacent apertures $m_6$, $m_{12}$ and $m_{16}$ are inclined by the angle $\alpha$ with respect to the axes $B_1$, $B_3$ and $B_4$ parallel to the Y axis and displaced by the distance d on the axes $A_1$, $A_3$, $A_0$ and $A_4$ parallel with the X axis, in comparison with those of the conventional shadow mask 7.

It is assumed here that the interval between the axes $A_0$ to $A_4$ along the X axis direction is 150 μm, the aforementioned distance d is 80 μm and the angle α is 15°. The angle α is preferably less than 20° in practice. This is because the space factor is degraded as the apertures are displaced from the respective axes $B_0$ to $B_4$ in the Y axis direction, i.e., as the angle α formed by lines K connecting the apertures adjacent in the Y axis direction and the axes $B_0$ to $B_4$ is increased, whereby the space factor as the dot pattern is hindered when the angle exceeds 20°. As will be appreciated by those skilled in the art, in view of the above described angular and lateral displacements of the apertures from the various axes, and as clearly observed in FIG. 5A, triangles formed by triads of adjacent apertures are neither equilateral nor isosceles triangles, as is common in the prior art arrangement of FIG. 3. Thus, the inventive structure provides an arrangement of adjacent scalene triangles.

Figure 4A:
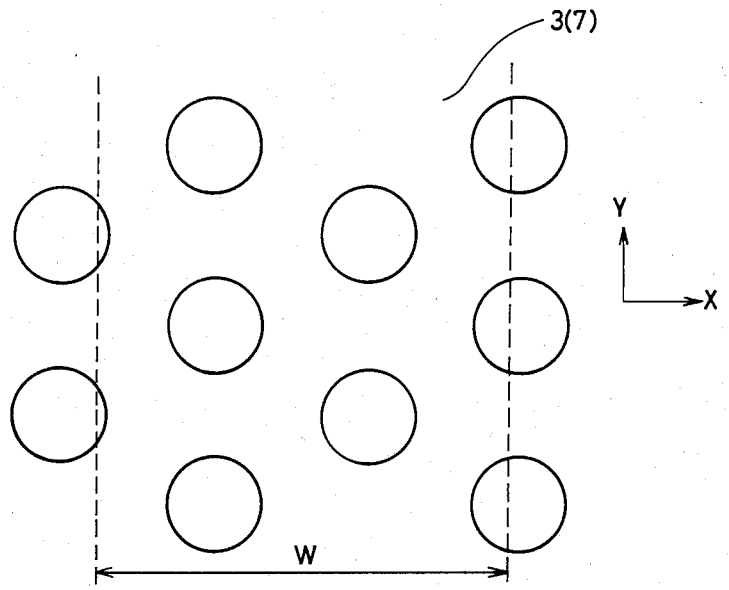
FIG.4A PRIOR ART
FIG. 4(A) illustrates an aperture array of a conventional shadow mask or a dot pattern on a display surface.
Figure 4B:
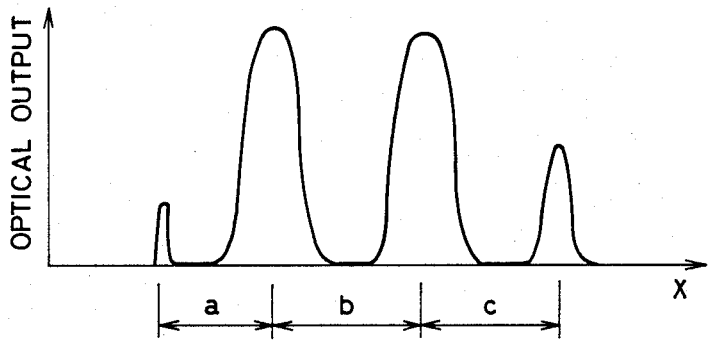
FIG.4B PRIOR ART
FIG. 4(B) is a characteristic diagram showing a light emission state of the display surface corresponding to FIG. 4(A)
Figure 5B:
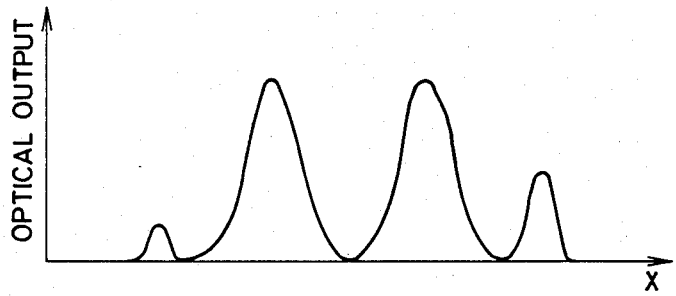
FIG. 5(B) shows a light emission state of a CRT employing the shadow mask or the dot pattern shown in FIG. 5(A)

FIG. 5(B) shows a light emission state of a CRT employing the shadow mask 7 according to the present invention, on which vertical lines of width W are displayed similarly to the case of FIG. 4. In comparison with the case of the conventional shadow mask 7 as shown in FIG. 4(B), the peaks of the optical output as shown in FIG. 5(B) are lower than those in FIG. 4(B) while base portions thereof are wider than the same. Considering the optical output, the dot pattern is decreased in contrast of the light and shade portions of images in comparison with the conventional one. This is useful to cope with the moiré phenomenon.

Figure 6:
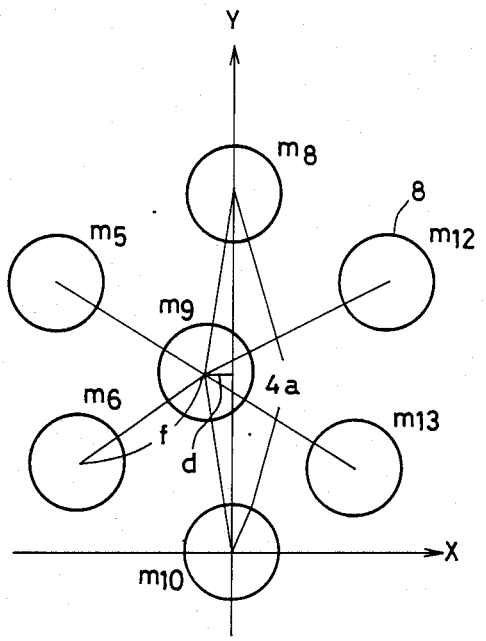
FIG. 6 shows a pattern of an aperture array of the shadow mask for illustrating a space factor phenomenon.

Description is now made on the space factor with reference to FIG. 6.

FIG. 6 shows a pattern of aperture array of the shadow mask for illustrating the space factor phenomenon.

Referring to FIG. 6, it is assumed that the distance between apertures $m_8$ and $m_{10}$ is represented by 4*a*. With reference to an aperture $m_9$, the distance between the apertures $m_6$ and $m_9$ is the smallest and of a problem with respect to the space factor. Assuming that the distance between the apertures $m_6$ and $m_9$ is represented by f, the following relation is obtained:

$$f = \sqrt{(d - \sqrt{3a})^2 + a^2}$$

Assuming that d=30 μm in place of d=80 μm as an actual (practical) value, f=274.4 μm, and no bad influence is exerted on the space factor. The value d may be further reduced to about 5 to 10 μm. Similarly to the description of the arrangement illustrated at FIG. 5A, the inventive arrangement shown at FIG. 6 results in adjacent scalene triangles, as observed by reference to the triads (M5, M9, M6) and (M6, M9, M10) for example.

Figure 7:
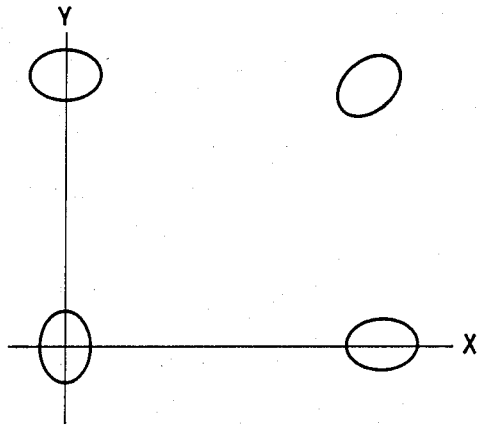
FIG. 7 illustrates spot forms of electron beams on a display surface.

As intensively shown on the quadrant I in FIG. 7, spot forms of electron beams from in-line type electron guns are vertically elongated at the central portion of the display surface 3 and horizontally elongated in peripheral portions such as end portions of the X axis while signal moirés in the peripheral portions are larger in lateral width with respect to electron beam than those in the central portion. Thus, it is preferable that the peripheral portions of the display surface 3 are smaller in color purity margin and the said angle α than those in the central portion in the shadow mask type. In other words, the angle α is preferably made smaller in the peripheral portions of the display surface 3 than that in the central portion so that no sacrifice of color purity margin is required. Examples of respective parameters in this case are a=150 μm and d=40 μm, i.e., α=7.6° in the central portion of the display surface 3, while the value d is reduced to set that α≈3.8° in the peripheral portion. Such an arrangement is illustrated in FIG. 10.

Figure 8:
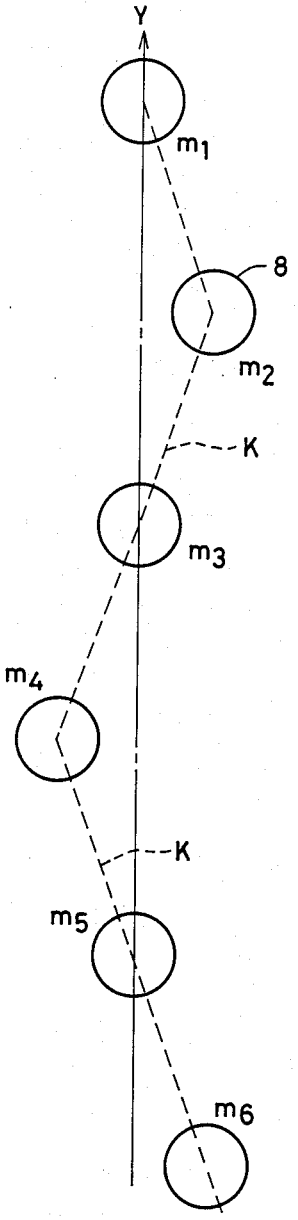
FIG. 8 illustrates an aperture array of a shadow mask or a dot pattern on a display surface according to another embodiment of the present invention.
Figure 9:
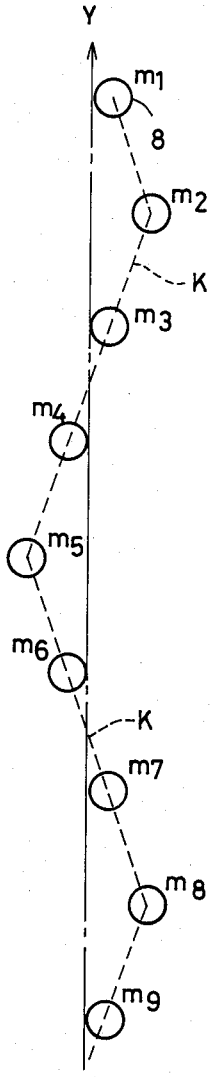
FIG. 9 illustrates an aperture array of a shadow mask or a dot pattern on a display surface according to still another embodiment of the present invention.

FIGS. 8 and 9 illustrate other embodiments of the present invention, with respect to a vertical train of apertures. In the embodiment as shown in FIG. 8, a line K connecting vertically adjacent apertures is alternately bent at $m_2$, $m_4$ and $m_6$. In other words, every three apertures 8 form a linear portion, so that the line K is formed in a zigzag manner as a polygonal line in the vertical direction, i.e., in the Y axis direction as a whole.

In the embodiment as shown in FIG. 9, a line K connecting adjacent apertures 8 is bent every two apertures at $m_2$, $m_5$ and $m_8$. In other words, every four apertures 8 form a linear portion so that the line K is formed as a polygonal line in the vertical direction as a whole. In these embodiments, it is also preferable to make the intersection angle of the polygonal line and the axis in the peripheral portion of the display surface 3 smaller than that in the central portion.

Although the lines K connecting the apertures adjacent in the direction of the minor axis Y of the display surface 3 are formed as polygonal lines in the aforementioned embodiments, the same background applies to those in the direction of the major axis X.

Although in the above embodiments the color picture tube has a shadow mask having an apperture pattern corresponding to the fluorescent dot pattern which is provided on the inner surface of a display surface, the present invention is also applicable to color picture tube comprising in place of a shadow mask light emitting points having a mosaic pattern corresponding to the dot pattern.

According to the present invention as hereinabove described, the adjacent apertures of the shadow mask are connected by the polygonal lines along at least one axial direction of the display surface thereby to reduce generation of moirés as well as coloring on line end portions caused by positional relation between the signals and the dot pattern. Particularly the said polygonal lines are bent in the peripheral parts of the display surface at an angle smaller than that in the central part, whereby sacrifice of color purity margin can be minimized.

Further, moirés can be reduced with respect to various signal pitches without increasing spot diameters of the electron beams.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A color picture tube comprising a display surface having a plurality of major axes defining a major axis direction and a plurality of minor axes defining a minor axis direction, said display surface being provided with a fluorescent dot pattern on an inner surface thereof and a shadow mask having an aperture pattern comprising a plurality of apertures corresponding to said fluorescent dot pattern, each dot of said dot pattern being disposed at a location defined by an intersection of a major axis and a minor axis, the apertures of said shadow mask being arrayed along any given axis of at least one of said major and minor axis directions, alternate one of said apertures along said given axis being displaced from intersections of said given axis with axes in the other of said major and minor axis directions, to provide a zig-zag array of said apertures along said given axis, such that a line connecting successive apertures along said given axis of said display surface is bent at least every other aperture to form a polygonal line with respect to said given axis.

2. A color picture tube in accordance with claim 1, wherein said polygonal lines appear on only one side of an axis indicating the direction of array of said apertures connected by said polygonal lines.

3. A color picture tube in accordance with claim 1, wherein said polygonal lines alternately appear on both sides of an axis indicating the axial direction of array of said apertures connected by said polygonal lines.

4. A color picture tube in accordance with claim 1, wherein an angle formed by said polygonal lines and an axis indicating the axial direction of array of said apertures connected by said polygonal lines is less than 20°.

5. A color picture tube comprising a display surface having a plurality of major axes defining a major axis direction and a plurality of minor axes defining a minor axis direction, said display surface being provided with a fluorescent dot pattern on an inner surface thereof and a shadow mask having an aperture pattern comprising a plurality of apertures corresponding to said fluorescent dot pattern, each dot of said dot pattern being disposed at a location defined by an intersection of a major axis and a minor axis, the apertures of said shadow mask being arrayed along any given axis of at least one of said major and minor axis directions such that a line connecting successive apertures along said given axis of said display surface is bent at least every other aperture to form a polygonal line with respect to said given axis, and an angle a formed by said polygonal line and an axis indicating the axial direction of array of said aperture connected by said polygonal line is larger in a central part of said display surface than that in peripheral parts of said display surface.

6. A color picture tube in accordance with claim 5, further comprising in-line type electron guns.

7. A color picture tube comprising a display surface having a plurality of major axes defining a major axis direction and a plurality of minor axes defining a minor axis direction and being provided with a fluorescent dot pattern on an inner surface thereof and light emitting points having a pattern corresponding to said fluorescent dot pattern, said light emitting points being arrayed along an axis in one of said major axis direction and said minor axis direction, alternate ones of said light emitting points arrayed along said axis being displaced from said axis to provide a zig-zag array along said axis, such that a line connecting successive light emitting points along said axis of said display surface is bent at least every other light-emitting point with respect to said axis to form polygonal lines.

8. In a color picture tube including a display surface having a plurality of major axes, defined by an in-line array direction of electron guns of the picture tube, and a plurality of minor axes oriented in a direction perpendicular to said direction of said major axes, said picture tube having a fluorescent dot pattern on an inner surface thereof and a shadow mask having an aperture pattern including a plurality of apertures corresponding to said fluorescent dot pattern, the improvement comprising an array of said apertures of said shadow mask, said apertures arrayed with a zig-zag orientation relative to at least one of said in-line direction and said perpendicular direction selected for reducing a moire phenomemon in an image displayed thereby wherein alternate ones of said apertures along said at least one direction are displaced from intersections with an axis in the direction perpendicular thereto for providing said zig-zag orientation.

9. A color picture tube as recited in claim 8 wherein said apertures of said shadow mask are arrayed so that lines connecting any pair of adjacent apertures are oblique to both said direction of said major axes and said direction of said minor axes.

10. A color picture tube as recited in claim 8 wherein said apertures of said shadow mask are arrayed so that any line connecting a pair of adjacent apertures forms a polygonal line intersecting both said direction of said major axes and said direction of said minor axes at predetermined angles.

11. A color picture tube as recited in claim 8 wherein said apertures are arrayed in a non-regular pattern wherein consecutive apertures arrayed along said direction of said minor axis have different displacements along said direction of said major axis.

12. In a color picture tube including a display surface having a plurality of major axes, defined by an in-line array direction of electron guns of the picture tube, and a plurality of minor axes oriented in a direction perpendicular to said direction of said major axes, said picture tube having a fluorescent dot pattern on an inner surface thereof and a shadow mask having an aperture pattern including a plurality of apertures corresponding to said fluorescent dot pattern, the improvement comprising an array of said apertures of said shadow mask, said apertures arrayed with an orientation relative to at least one of said in-line direction and said perpendicular direction selected for reducing a moire phenomenon in an image displayed thereby, and the apertures of said shadow mask are arrayed such that triads of adjacent apertures form scalene triangles.

13. In a color picture tube including a display surface having a plurality of major axes, defined by an in-line array direction of electron guns of the picture tube, and a plurality of minor axes oriented in a direction perpendicular to said direction of said major axes, said picture tube having a fluorescent dot pattern on an inner surface thereof and a shadow mask having an aperture pattern including a plurality of apertures corresponding to said fluorescent dot pattern, the improvement comprising an array of said apertures of said shadow mask, said apertures arrayed with an orientation relative to at least one of said in-line direction and said perpendicular direction selected for reducing a moire phenomenon in an image displayed thereby, said apertures of said shadow mask are arrayed so that any line connecting a pair of adjacent apertures forms a polygonal line intersecting both said direction of said major axis and said direction of said minor axes at predetermined angles, and said predetermined angle for intersecting said minor axis is smaller at peripheral portions of the display surface than at central portions thereof.

14. In a color picture tube including a display surface having a plurality of major axes, defined by an in-line array direction of electron guns of the picture tube, and a plurality of minor axes oriented in a direction perpendicular to said direction of said major axes, said picture tube having a fluorescent dot pattern on an inner surface thereof and a shadow mask having an aperture pattern including a plurality of apertures corresponding to said fluorescent dot pattern, the improvement comprising an array of said apertures of said shadow mask, said apertures arrayed with an orientation relative to at least one of said in-line direction and said perpendicular direction selected for reducing a moire phenomenon in an image displayed thereby, and said apertures are arrayed in a non-regular pattern wherein consecutive apertures arrayed along said direction of said major axis having different displacements along said major axis from intersections with consecutive ones of said minor axis.

* * * * *